United States Patent [19]

Skeie

[11] Patent Number: 4,791,999

[45] Date of Patent: Dec. 20, 1988

[54] WELL DRILLING APPARATUS

[75] Inventor: Bjarne E. Skeie, Kristiansand, Norway

[73] Assignee: Maritime Hydraulics A.S., Kristiansand, Norway

[21] Appl. No.: 828,334

[22] Filed: Feb. 11, 1986

Related U.S. Application Data

[63] Continuation-in-part of Ser. No. 609,883, May 14, 1984, Pat. No. 4,593,773.

[30] Foreign Application Priority Data

Jan. 25, 1984 [NO] Norway ..... 840285

[51] Int. Cl.[4] ..... E21B 19/16; E21B 3/02

[52] U.S. Cl. ..... 175/85; 173/164

[58] Field of Search ..... 175/85, 52, 170, 195; 173/164, 165; 166/77.5

[56] References Cited

U.S. PATENT DOCUMENTS

| | | | |
|---|---|---|---|
| 2,488,107 | 11/1949 | Abegg | 166/77.5 |
| 3,695,364 | 9/1972 | Porter et al. | 175/85 X |
| 3,726,348 | 4/1973 | Seegan | 173/20 |
| 3,734,212 | 5/1973 | Perlewitz | 175/85 X |
| 3,776,320 | 12/1973 | Brown | 173/163 |
| 3,857,450 | 12/1974 | Guier | 175/85 |
| 4,421,179 | 12/1983 | Boyadjieff | 173/44 |
| 4,449,596 | 5/1984 | Boyadjieff | 175/85 |
| 4,489,794 | 12/1984 | Boyadjieff | 175/85 |
| 4,529,045 | 7/1985 | Boyadjieff et al. | 173/164 |
| 4,574,893 | 3/1986 | Young et al. | 175/170 |

*Primary Examiner*—George A. Suchfield
*Assistant Examiner*—David J. Bagnell
*Attorney, Agent, or Firm*—Cushman, Darby & Cushman

[57] ABSTRACT

A well drilling apparatus of the type suspended from a travelling block in a derrick for movement upwardly and downwardly with a drill string. The apparatus includes an upper nonrotatable unit comprising a drive meter for rotation of a hollow drive shaft connectable to the drill string. The apparatus further includes a lower unit or pipe handler apparatus, the lower unit being rotatable relative to the upper unit, preferably by a motor. The apparatus also includes a swivel transferring compressed air and/or hydraulic fluid from the upper non-rotatable unit to the lower rotatable unit.

6 Claims, 5 Drawing Sheets

WELL DRILLING APPARATUS

This is a continuation-in-part of application Ser. No. 609,883, filed May 14, 1984, now U.S. Pat. No. 4,593,773.

The present invention relates to a well drilling apparatus of the type suspended from a travelling block in a derrick for movement upwardly and downwardly with a drill string. The apparatus includes an upper unit comprising drive means for rotation of a hollow drive shaft connectable to the drill string and means for retaining the upper unit against rotation. The apparatus further includes a lower unit or pipe handler apparatus comprising a torque wrench or means for connection or disconnection between the drive shaft and the drill string, a link hanger from which two links supports an elevator.

On the type of drilling equipment utilized most frequently today, a rotatable, polygonal pipe, known as a kelly, is suspended from the hoist hook above a mud swivel. The kelly is threaded at the lower end and attached by means of the latter to the complementary threading in the upper end of the drill string. The kelly is rotated by means of a rotary table and gradually moves axially in relation to the rotary table as the drill bit descends. One of the disadvantages of this system is that it can handle only a single, 30-foot section of drill pipe at a time. During a tripping operation i.e. when the drill string is pulled up or lowered down into the well, the drill string is admittedly divided into stands, each stand consisting of three lengths of pipe. These are stored in racks as they are hoisted up from the well and disconnected from the rest of the drill string. The drill pipe is thus stored in stands of three pipe sections in the pipe racks. However, when new drill pipe needs to be added to the string during drilling, only a single length of 30-foot-long drill pipe may be entered and rotated into the last pipe on the drill string, and the upper end of the new pipe attached to the kelly. This is a relatively time-consuming procedure. Considering that new drill pipe must be added to the string several times an hour, it can be easily understood that substantial savings of time and money could be achieved if this procedure can reduce the number of operations to one-third by adding whole stands during the drilling, each stand consisting of three single sections.

On a more modern, prior art apparatus, the rotary device itself is attached to the travelling block of the draw-works on the derrick. The rotary device turns a shaft which is rotatably suspended from the mud swivel. With this equipment, an entire pipe stand consisting of three sections of pipe of 90 feet total length can be connected to the upper end of the drill string. This obviously saves both time and work. A disadvantage of this apparatus is that it is not possible, at least not without special, time-consuming modifications, to carry out a tripping operation. The main reason is that some twisting builds up in the drill string during drilling. The twisting may in fact constitute several turns of the string when the upper and lower end of the drill string are seen in relation to each other. This twist causes powerful torque to be applied to the drill string and, in turn, to the drilling apparatus. When drilling is finished and tripping is to be performed, the upper end of the drill string is enclosed by the elevator. When the drill string is lifted, it is suspended in the elevator.

The lower part of the drill string will often during the lifting operation be prevented from rotating freely, whereby twisting will still be present in the string, to be transferred to the elevator and, in turn, to the link hanger. The powerful torque, and the rather rough handling of the drill string during lifting may, in extreme cases when the string is still in a twisted state, cause the individual drill pipes to unscrew from each other, which leads to operations requiring considerable resources, a situation to be avoided at all costs. This is remedied through the present construction in that a slewing ring bearing and an auxiliary motor have been provided above the link-hanger, as well as an air/fluid transfer apparatus in order to allow re-twisting and relieving of the drill string during tripping.

The lower part of the known apparatus is, admittedly, mounted so as to be rotatable to a certain degree, however, here the transfer of hydraulic fluid and air from the fixed part of the apparatus to the rotatable part occurs through a number of hoses, which means that if tripping is to be performed, these hoses would have to be disconnected. Other disadvantages are also present if the known apparatus were to be used for tripping with the drill string, because the apparatus has not been constructed with this function in mind. Therefore, tripping is performed in the conventional manner.

Another disadvantage is that entering of the conical threaded joints between the pipes and the shaft of the well drilling apparatus has to be effected by moving the entire drilling apparatus with the draw-works in the vertical direction, which involves large and unruly masses, resulting in a risk of impacts and bumps during the alignment of the connections, with a great danger of damaging the threads of the joints.

The object of the present invention is to provide a drilling apparatus of the type recited above which does not have the above-mentioned disadvantages, and which is constructed for performing the tripping function and thus is admirably suited for this, as well as having a number of other advantages.

This is obtained according to the invention by a well drilling apparatus of the type recited in the introduction, a type which is characterized in that the pipe handler or lower unit including the means for connection or disconnection between the drive shaft and the drill string, the link hanger, the links and the elevator is independently rotatable in any angular position or desired number of revolutions relative to the upper unit of the well drilling apparatus, preferably by means of a motor. The apparatus further includes a compressed air/hydraulic fluid swivel transferring compressed air and/or hydraulic fluid from the upper nonroratable unit to the pipe handler or lower rotatable unit.

Other features of the invention are disclosed in the subsidiary claims.

The invention will be described more detailed in the following with reference to the accompanying drawings, which show a preferred embodiment of the invention.

FIG. 4(*b*) shows a closer view of the area shown by the circle of dashed lines in FIG. 4(*a*).

Figure 1:
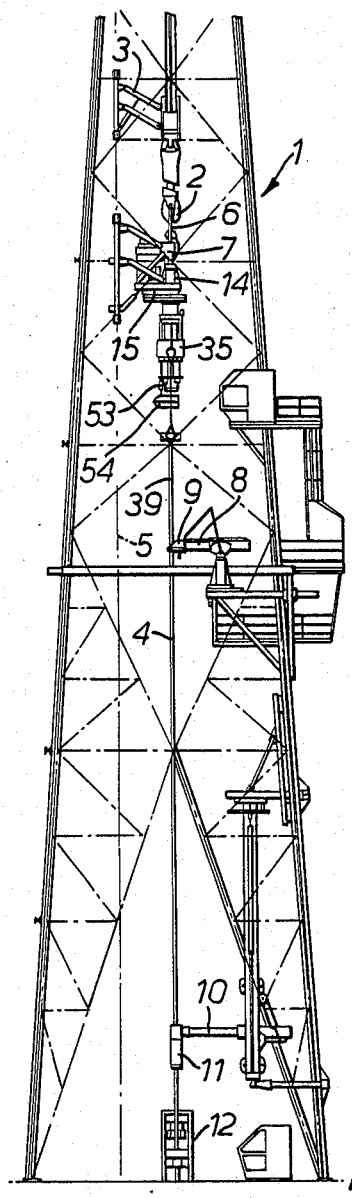
FIG. 1 shows a portion of a derrick provided with the well drilling apparatus of the invention.
Figure 2:
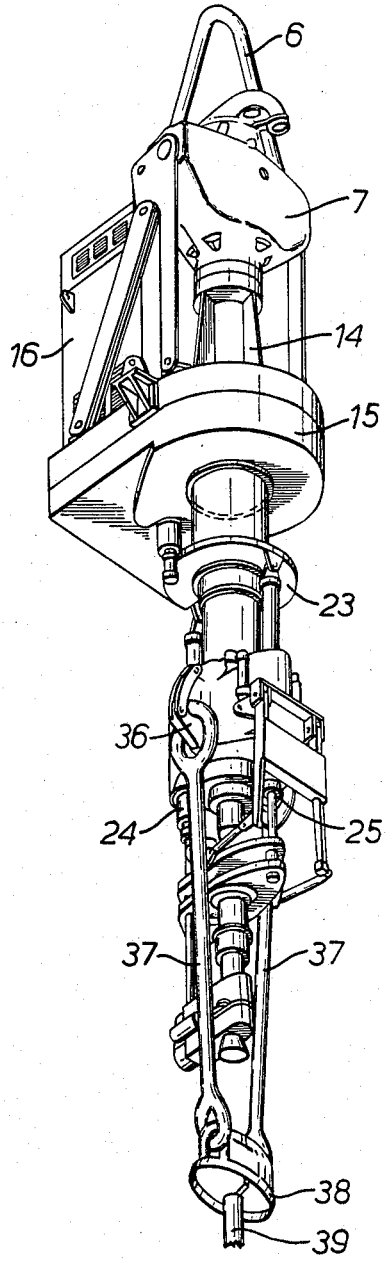
FIG. 2 is an isometric drawing of the apparatus of the invention.
Figure 3:
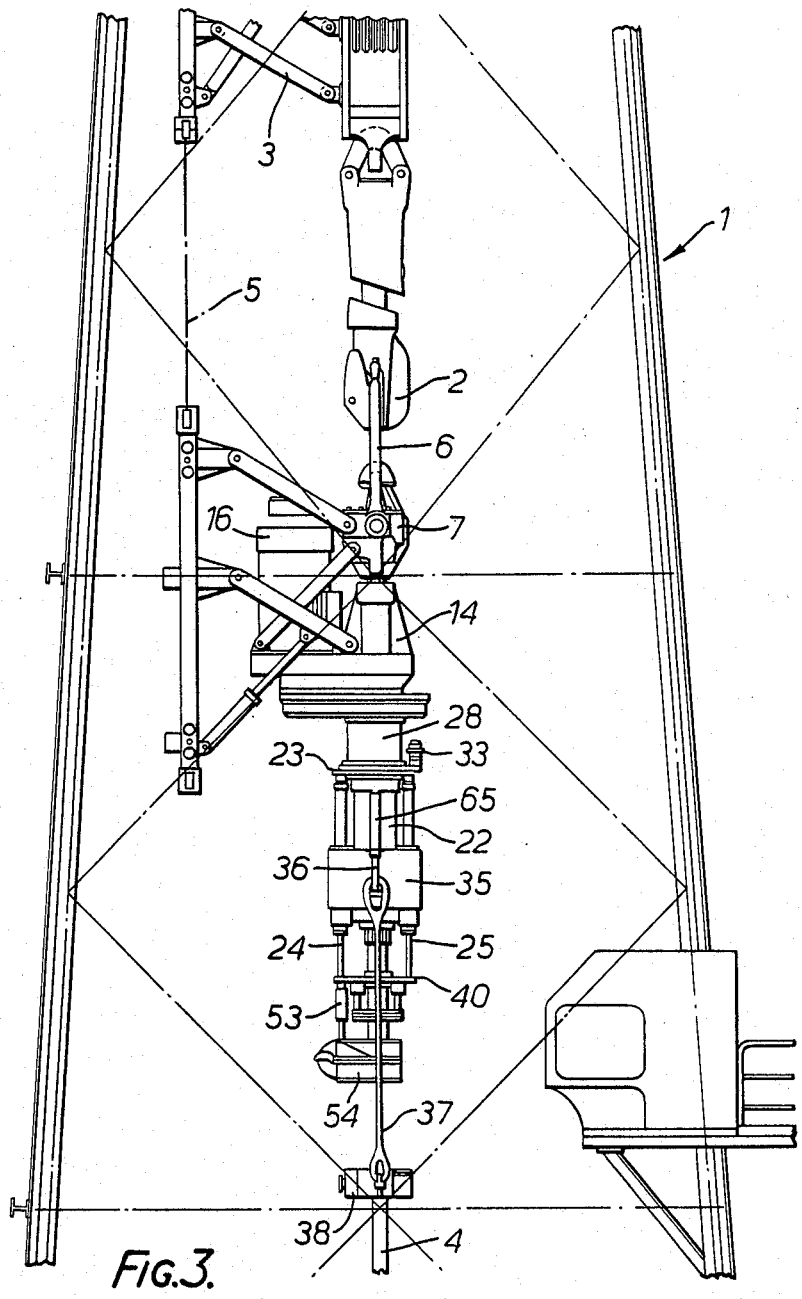
FIG. 3 shows a simplified sketch of the well drilling apparatus of the invention, suspended from the hoist hook within the derrick.

On an oil derrick 1, a travelling block is provided in a manner allowing lifting, to which is attached a crane hook 2, which crane hook can be moved vertically by means of a draw-works, which is not illustrated in the drawing. With the aid of parallel arms 3, the hook can also be moved in the lateral direction, and be guided approximately vertically along the rails 5. Via a link 6, a mud swivel 7 is suspended from the crane hook, through which mud is supplied to the drill string 4 . Inside the derrick frame, an upper grab tool 8 with a grab head 9 together with a lower grab arm 10 with a rotatable grab head 11 can move a stand from an operative position to a rack on the derrick, and vice versa, during tripping. Down on the rig floor a roughneck 12 is provided, comprising a torque wrench and a spinner which rotate a length of pipe in such a way that a joint is screwed together and correct torque is applied, and, conversely, releases the joints and rotates the upper section out of the drill string.

Figure 4A:
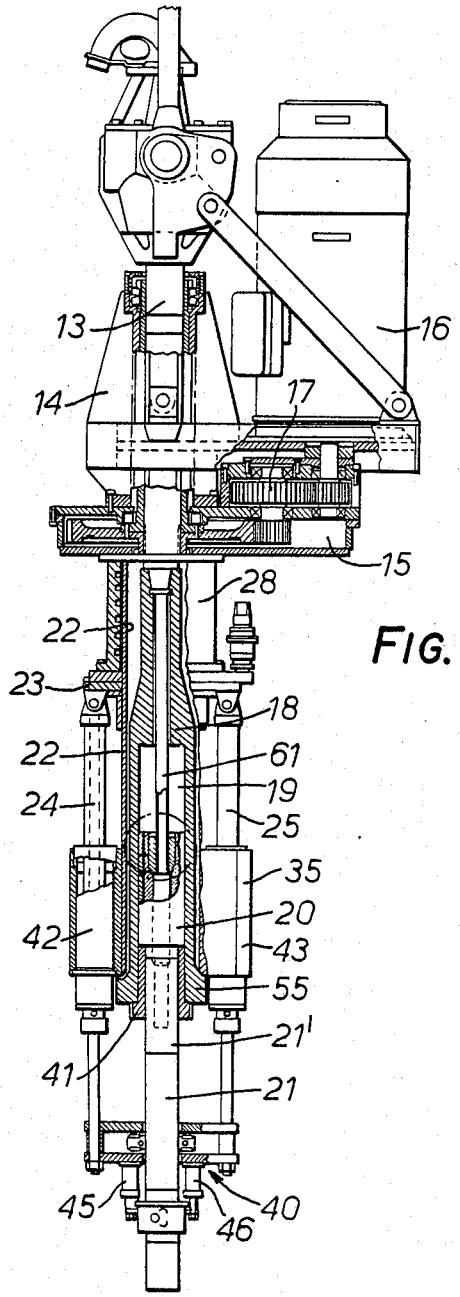
FIG. 4(*a*) shows a part of the drilling apparatus of the invention in partial cross section.

The apparatus may include a hollow shaft assembly 13 (see FIG. 4*a*) provided below the swivel 7, which freely rotates in the swivel. Conveniently, the shaft is divided into a plurality of detachable parts, known as subs. The shaft 13 is rotatably mounted within a support means 14 to which a gear box 15 is rigidly attached. A powerful rotary motor 16 is mounted on the gear box, driving the shaft 13 via a transmission gear 17. The gear box can be blocked by a pawl (not shown). The above-recited parts are included in the upper nonrotatable unit of the drilling apparatus.

The well drilling apparatus further includes a swivel 28 for the transfer, with no need of hoses, of compressed air/hydraulic fluid from the nonrotatable unit to a rotateable unit including a torque wrench 54, a link-hanger 35 with suspended links 37 which supports the elevator 38. The lower unit may further include a bearing cage 40 and hydraulic cylinders 24, 25, 45, 46. The torque wrench 54 connects and disconnects the joints between each drill pipe.

The shaft 13 has an expanded section 18 with a central ventilated cavity 19 within which a shaft head 20 can move freely. Around the periphery of the inner surface of the head 20, seals 60 are provided, which coact with a centrally disposed pipe 61, which extends inside the shaft 13 from its upper section and a distance into the moveable shaft head 20. A downward-extending shaft pin 21 is sealingly attached to the shaft head 20, ensuring liquid-tight communication for mud in the central regions of the shaft 1, the pipe 6!, and the shaft pin 21. A carrier part 41 is attached in the lower end of the expanded section 18 of the shaft 13. The carrier part 41 has internal, longitudinal splines, while a section 21 of the shaft pin 21 has external, longitudinal splines for slideable guide, interaction, and the transfer of torque from the expanded section 18 to the shaft pin 21 during drilling. At the same time, the carrier part 41 has an upper shoulder, against which the shaft head 20 rests during drilling (the drill string in tension). According to the above, the shaft head 20 can move telescopically along the pipe 61 in the cavity 19, restricted by the upper end wall of the cavity and the shoulder of the carrier part 41.

Outside the expanded section 18 of the shaft 13, an annular flange 23 is provided, with lugs connected for the attachment of hydraulic cylinders 24,25. Hydraulic cylinders 42,43 are provided outside the hydraulic cylinders 24, 25, so that they are constructed as two hydraulic cylinders inside one another, where the cylinders 24, 25 constitute the piston rods for the hydraulic cylinders 42, 43, said piston rods being provided with stationary pistons 44. See FIG. which shows the cylinder 42 in its upper position.

Figure 5:
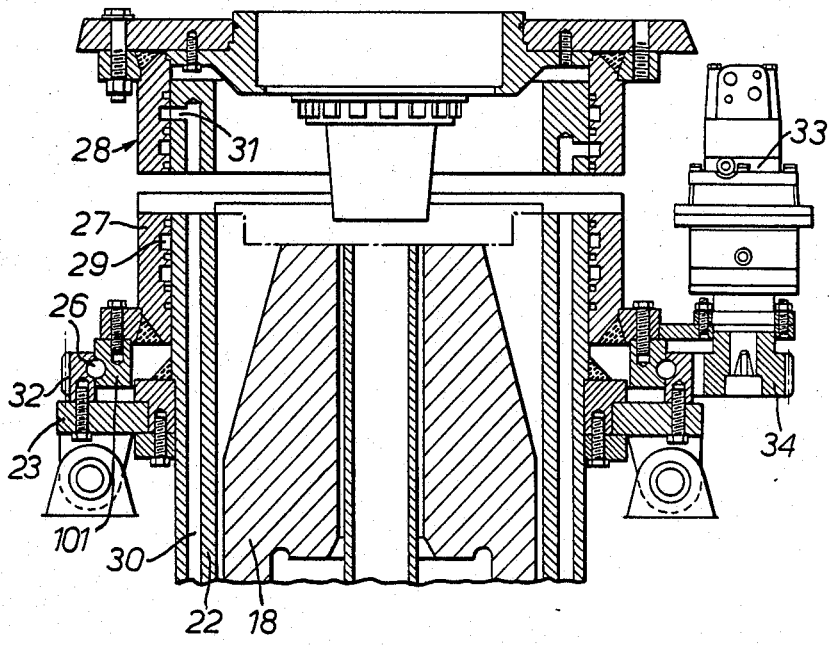
FIG. 5 shows a detail of the drilling apparatus of the invention in vertical section.
Figure 7:
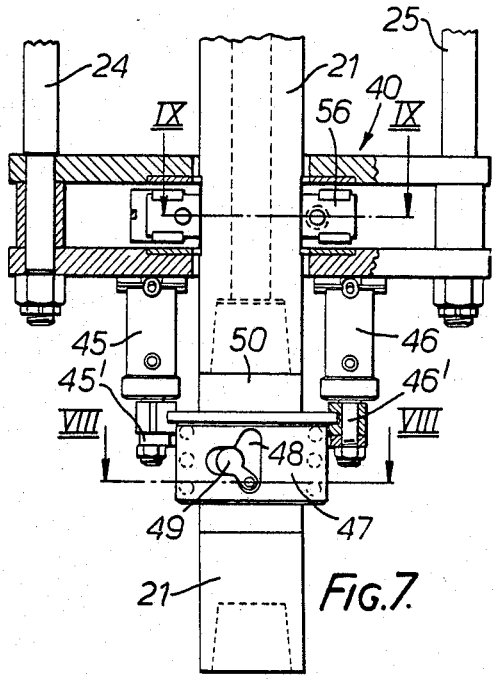
FIG. 7 shows another detail of the drilling apparatus of the invention in partial cross section.
Figure 8:
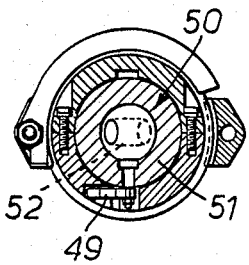
FIG. 8 is a cross section along the line VIII—VIII in FIG. 7.
Figure 9:
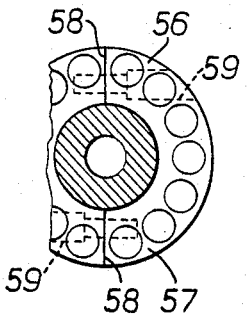
FIG. 9 is a cross section along the line IX—IX in FIG. 7.

The internal or lower parts of the hydraulic cylinders 24, 25 are connected to a bearing cage 40 with centrally positioned sliding bearing surfaces for interaction with a sliding bearing 56, which together constitute a thrust bearing 40, 56. The bearing 40, 56 is shown in FIG. 7 and FIG. 9. The sliding bearing 56 is attached to the shaft pin 21 both non-rotatably and so as to prevent the bearing from moving axially in relation to the shaft pin. On activation of the internal or lower hydraulic cylinders 24, 25, these actuates the bearing cage 40, which in turn acts on the sliding bearing 6. The bearing 56, which is permanently fixed to the shaft pin 21, thus operates the shaft pin 21 and the shaft head 20. This operation can be performed with the shaft pin 21 rotating. The above-recited function will have a significant advantage over prior art equipment for smooth entering of the conical threaded joints between the upper end of a drill pipe and the outwardly extending pin 21 when supplying pipe for the extension of the drill string during drilling. However, the above described feature are not strictly necessary to carry out a drilling and tripping operation, this equipment may be omitted from the apparatus if desired. Outside the expanded section 18 of the shaft 13, a rotatable sleeve 22 is provided (see FIG. 5), which is suspended via an axial bearing 26, through an annular flangering 101 and to a skirt 27, which in turn is attached under the gear box 15. In order to perform all functions on the well drilling apparatus, such as operating the hydraulic cylinders 24, 25, the cylinders 45, 46, the elevator 38 and the torque wrench 54, compressed air and/or hydraulic fluid is supplied being controlled from a control panel. As previously mentioned, twisting will occur in the drill string during drilling, and the drill string must be untwisted during tripping. In order to maintain the above-recited functions during the un-twisting of the string, when the complete lower section, including the elevator 38, the torque wrench 54, the bearing cage 40, the hydraulic cylinders, 24,25, 45,46, the link-hanger 35, the links 37, and the sleeve 22 are moving with the string, it must be possible to transfer compressed air/hydraulic fluid from the upper, non-rotatable unit of the well drilling apparatus to the lower, rotatable unit of the apparatus. This is enabled by cooperation of the upper part of the sleeve 22 and the skirt 27 which forms an air/hydraulic fluid swivel 28, provided for the air/fluid transfer from the stationary part 27 to the rotatable part 22. Compressed air/hydraulic fluid is supplied via hoses (not shown) to a number of separate grooves 29 running along the inner circumference of the skirt 27. Between each groove, seals are provided. The grooves 29 correspond to a similar number of axial passages 30 via a similar number of transverse passages 31, so that air/fluid may be transferred from the groove 29 to the transverse passage 31 and the passages 30, irrespective of the relative position between the rotatable part 22 and the stationary part 27. The passages 30 are in turn connected to hoses which extends to the individual components (elevator, torque wrench, etc.). In this way, compressed air/hydraulic fluid is transferred without need of hoses from the upper nonrotatable unit of the well drilling apparatus to the lower rotatable unit.

Figure 4B:
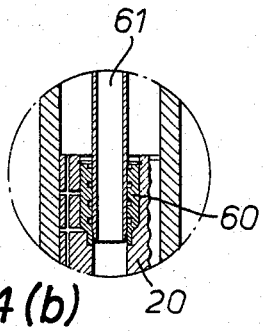
Figure 6:
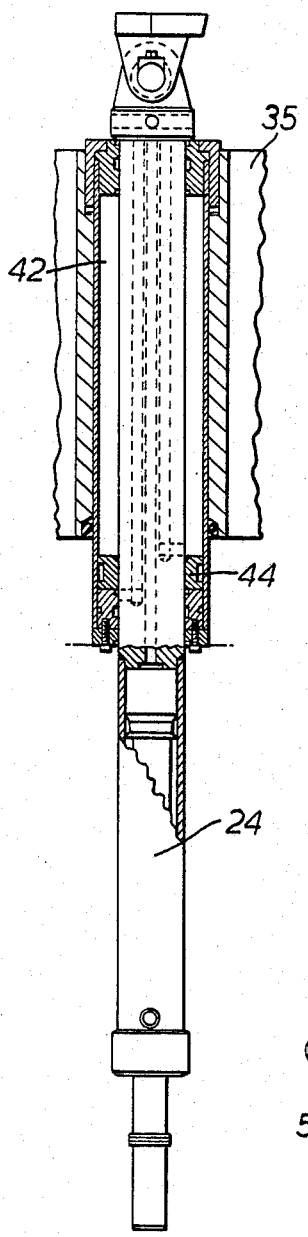
FIG. 6 is a more detailed illustration of the hydraulic lifting devices.

The external wall of the hydraulic cylinders 42,43 supports the link-hanger 35 (see FIGS. 4(*a*), 4(*b*) and 6). When fluid is supplied to the outer cylinders 42,43 above the stationary pistons 44, the link-hanger 35 will be raised, and may be lowered again on the return of the fluid, optionally supplying fluid under the stationary pistons 44. (See broken-line passages, FIG. 6 Moreover, the link-hanger 35 is non-rotatably connected to the sleeve 22, said sleeve being provided with a massive external glide key 65, and the internal bore of the link-hanger 35 is provided with corresponding key grooves, in order to rigidly transfer a considerable torque. From the lugs 36 provided on the link-hanger 35 the links 37 are suspended, supporting the elevator 38. The elevator 38 is a device having a central bore of a shape complementary to the upper, expanded end of a drill pipe 39. The elevator may be divided so that it may be inserted over the upper, expanded end of the drill pipe.

The elevator 38 and the link-hanger 35 follow each other and will normally adopt one of three positions. The upper position is adopted during drilling when the drilling equipment approaches the rig floor in order to get as close as possible to this with the drilling equipment itself. During normal drilling, tee link-hanger 35 rests freely on Belleville springs (not shown), which springs rest against the lower collars of the hydraulic cylinders 24,25 (or the piston rods). During the tripping operation, the Belleville springs are compressed until the link-hanger 35 stops against an external shoulder (FIG. 4) on the lower part 55 of the expanded section 18 of the shaft 13, thus resulting in the load being transferred from the elevator 8 via the links 7 to the link-hanger 5 and on to the shaft 13 via the shaft sections 55 and 18.

During un-twisting of the drill string, the twisting may be relieved by a motor 3 (Fi. 5), the pinion 34 of which engages with a gear wheel 2, which is connected to the annular flange 23 and supported via the bearing 26 by the flange ring 101 and permanently connected to the annular flange 23. The motor 33 may also be used for rotating the elevator into the correct position when said elevator is to open/close for, respectively, the insertion/fetching of stands of drill pipe into/from the pipe racks.

Two hydraulic cylinders 45 and 46 are provided under the bearing cage 40. The piston rods 45' and 46' cooperate with an axially slidable sleeve 47, having a guide channel 48, which operates a handle 49 of an internal blow-out preventer, known as an IBOP 50, which is clearly seen in Fi. 8. This consists of a turnable, spherical body 52 having a counterbore 51, i.e. some sort of a ball valve. On operation of the handle 49, the ball may be rotated for opening, respectively closing, of the through passage in the drill string, in the same way as a conventional two-way cock. To the lower side of the bearing cage 40 the torque wrench 54 is attached via a strut member 53.

The invention works in the following manner during drilling. Through the action of the rotary motor 33 via the pinion 34, gear wheel 32, sleeve 22, link-hanger 35 and links 37, the elevator 38 is set in the correct angular position for receiving a stand of drill pipe. The travelling block with the entire drilling apparatus is guided into an upper position, as shown in FIG. 1. By means of the pipe handling equipment 8, 9, 10, 11, a pipe is guided into operative position and into the open elevator, while simultaneously the handling system lowers the pipe into the upper joint on the last pipe of the drill string, which is held in a fixed position at the rig floor in wedge slips. For the connection of a new stand of pipe, and for the application of sufficient torque to the joints, the iron roughneck 12 which is provided on the ri floor, is employed. Thereafter, the entire drilling apparatus is lowered, so that the upper joint of the drill pipe is entered by the telescopic shaft pin 21. While the drill string remains held fixedly by the wedge slips, the shaft i is rotated by means of the rotary motor 16, and the threads are screwed in. The torque wrench 54, which comprises two jaws arranged one above the other, the jaws being to some extent turnable in relation to each other, adds the joint between the drill pipe and the shaft pin 21 with sufficient torque.

During tripping, when the drill bit is to be pulled out of the well, a stand of pipe is hoisted up from the well, and the upper end of the next stand is fastened by means of the wedge slips. The stand, consisting of three lengths of pipe, is then detached from the rest of the drill string at the rig floor level by means of the torque wrench on the iron roughneck. The spinner on the iron roughneck 12 then rotates the stand so that the entire threaded connection is released. During this operation, the elevator 38 has been moved a short distance downwardly, so that the upper end of the stand of pipe can rotate freely in relation to the elevator. The stand, which is now detached, is clamped by the grab tools 8 and 10 and transported to the pipe rack, while simultaneously the elevator is opened and rotated in the correct direction for removing the pipe. When the pipe is being hoisted up, the entire drill string is suspended from the shaft 13, as mentioned above. In addition, the hydraulic cylinders 42 and 43 may act like springs. The hydraulic oil then flows over a circuit with an adjustable valve, so that at a predetermined load on the links 37, oil will bleed out from the upper chamber in the hydraulic cylinders above the piston 4, and thus the link-hanger 35 will be pulled down so that their lower edge rests against a substantial shoulder on the part 55 on the expanded section 18 of the shaft 13. In this way, the weight of the entire drill string may be transferred to the travelling block.

As mentioned above, a rather high degree of twist may be imparted to the drill pipe owing to the nature of the well itself. This torque can be taken up without problems by the apparatus during tripping, because the link-hanger 35 can rotate controllably in relation to the upper section of the drilling apparatus. If the drill pipe sticks during the pulling operation, the pipe must be rotated and mud pumped down into the well. This is done by coupling the outwardly extending shaft pin 21 to the upper part of the drill string, so that the entire weight of the drill string now hangs in the normal manner from the apparatus as it does during drilling, except that the drill string is now being hoisted up while being rotated instead of being lowered down into the well.

The apparatus of the invention comprises three separate, independently movable systems. The cylinders 24 and 25 can move the pin 21 in and out, and thus shorten or extend the shaft length 13. By means of the external hydraulic cylinders 42 and 43, the link-hanger 35 can be moved independently up and down on the sleeve 22, i.e. in relation to the shaft 13, and thus the elevator 38 is movable up and down independently of the shaft 13. In addition, the link-hanger 35 with associated parts may be rotated in relation to the upper section of the well drilling apparatus.

The thrust bearing 40, 56 comprises, as previously mentioned, of a sliding bearing 56 and a bearing cage 40 with sliding surfaces as can be seen in FIG. 7 and Fi. 9. The sliding bearing 56 is attached to the shaft in such a manner that it has high inertial resistance both to rotation and to axial movement in relation to the shaft. As seen in FIG. 9, the the bearing ring 57 is divided diametrically at 58. The two bearing ring members are held together by bolts 59, indicated by broken lines in FIG. 9. The object of a separatable bearing is to enable the piston rods on the hydraulic cylinders 24 and 25 to be moved upwardly without operating the shaft pin 21. To enable this, the handle 49 for operating the valve body 51 in the IBOP 50 must be removed. The sleeve 47 with the guide channel 48 can then slide outside the IBOP. The purpose for this is to permit maintenance work on the IBOP or to allow a check valve to be introduced into the drill string. The hydraulic cylinders 24, 25 are drawn up high enough that the torque wrench 54 can break loose the upper joint for the IBOP. This provides sufficient access for overhauling or replacing the IBOP.

If the driller, during a tripping operation, notices that the well is out of balance, the shaft 13 can at any time be entered into the drill pipe and the IBOP can be closed by remote control. A check valve with barbs is then inserted into the drill string through the opening 52 in the valve body 51 in the IBOP after this has been opened just long enough to allow the valve to be guided down into the drill string. The IBOP is then reconnected to the pin 21. When mud is subsequently pumped, the check valve will be forced downwardly in the pipe. Tripping to get the drill bit down to the bottom of the well can then commence.

Having described my invention, I claim:

1. A well drilling apparatus of the type suspended from a travelling block of a derrick for movement upwardly and downwardly with a drill string to perform drilling and round trip operations, said apparatus including:

an upper unit comprising drive means for rotating a hollow drive shaft connectable to said drill string;

means retaining said upper unit against rotation;

a pipe handler apparatus comprising: a link hanger from which two links support an elevator, and a torque wrench for connecting and disconnecting said drive shaft and drill string;

mounting means for allowing said pipe handler apparatus to independently rotate relative to said upper unit to any angular position or desired number of revolutions; and swivel means for transferring operating fluids such as compressed air and hydraulic fluid, between said upper unit and said pipe handler apparatus.

2. An apparatus according to claim 1, characterized in that said swivel means includes an annular flange to which a gear wheel is fixed for engagement with a pinion of a motor for controlled rotation of said pipe handler apparatus.

3. An apparatus according to claim 2, characterized in that said swivel means includes a skirt fixed to said upper non-rotatable unit and a sleeve fixed to said pipe handler apparatus, said skirt being provided with one or more grooves extending circumferentially along the inner surface of said skirt, wherein said grooves communicate with corresponding passages in said sleeve.

4. An apparatus according to claim 3, characterized in that between each annular groove in said skirt seals are provided for sealingly engaging said sleeve for selective transmission of pressurized air or other fluid between said respective grooves in said skirt and said corresponding passages in said sleeve.

5. An apparatus according to claim 3, characterized in that said mounting means is an axial bearing.

6. An apparatus according to claim 5, characterized in that said axial bearing is provided between said gear wheel and a lower annular flange ring of said skirt.

* * * * *